United States Patent [19]

Schupphaus

[11] 4,394,053

[45] Jul. 19, 1983

[54] NOZZLE HOLDER FOR CUTTER DRUM IN LONGWALL MINING MACHINERY

[75] Inventor: Herbert Schupphaus, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 324,529

[22] Filed: Nov. 24, 1981

[30] Foreign Application Priority Data

Nov. 28, 1980 [DE] Fed. Rep. of Germany ..... 3044874

[51] Int. Cl.[3] ..... E21C 35/22; E21C 27/24

[52] U.S. Cl. ..... 299/81; 299/87

[58] Field of Search ..... 299/81, 87; 175/393

[56] References Cited

U.S. PATENT DOCUMENTS

| | | | |
|---|---|---|---|
| 1,674,969 | 6/1928 | Glaser | 299/81 |
| 3,747,982 | 7/1973 | Agnew et al. | 175/393 |

FOREIGN PATENT DOCUMENTS

| | | | |
|---|---|---|---|
| 655 | of 1888 | United Kingdom | 299/81 |
| 1110763 | 4/1968 | United Kingdom | 299/81 |
| 1550475 | 8/1979 | United Kingdom | 299/81 |
| 2038915 | 6/1980 | United Kingdom | 299/81 |

*Primary Examiner*—Ernest R. Purser
*Assistant Examiner*—Joseph Falk
*Attorney, Agent, or Firm*—Thomas H. Murray

[57] ABSTRACT

In cutter-drum apparatus wherein a cutter drum is provided near the back of the cut with a nozzle holder and nozzles for comminuting without dust evolution of the harder material at the back of the cut, improvements whereby (a) the nozzle holder is frusto-conical to accommodate the bulging of the face at the back of the cut, and (b) the cutter drum has a frusto-conical end ring which bears cutter picks that intersect the jets emerging from the nozzles. These cutter picks give the jets a pulsating action, which increases their effectiveness.

8 Claims, 1 Drawing Figure

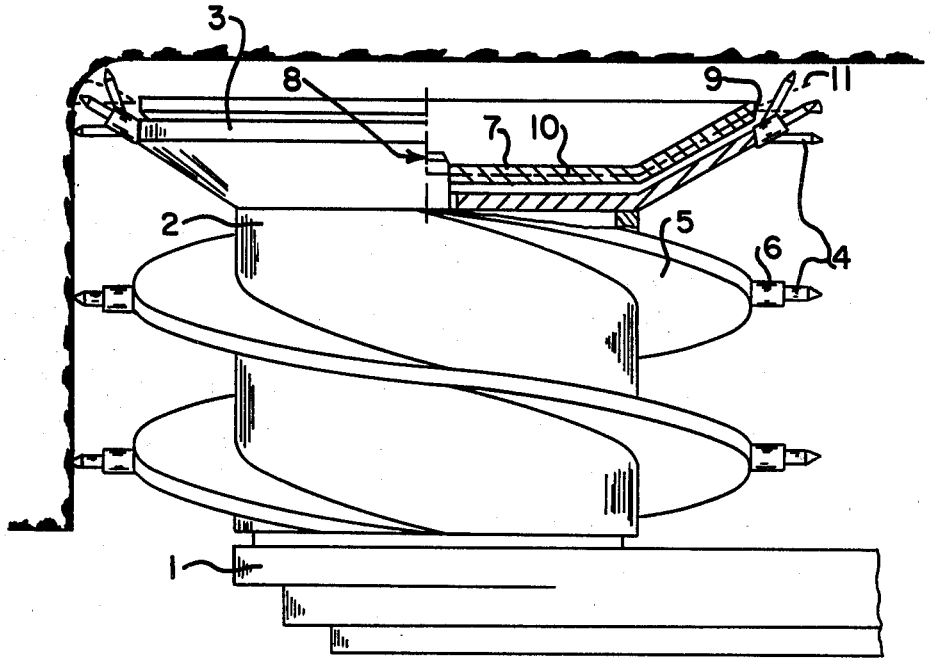
3
8
9
11
7
10
2
5
6
4
1

NOZZLE HOLDER FOR CUTTER DRUM IN LONGWALL MINING MACHINERY

BACKGROUND OF THE INVENTION

1. Field of the Invention

This invention relates to longwall mining machinery, and in particular, to improvements to a longwall mining machine of the type having a pivot arm which supports a cutter drum for rotation about an axis for working a mine face. In a mining machine of this type, the rotating cutter drum, which carries cutting bits on its outer periphery, is provided with spirals which assist in loading the mined material onto a face conveyor.

2. Description of the Prior Art

In U.S. patent application Ser. No. 288,037, filed July 29, 1981, there is described a cutter drum, in equipment of the type indicated above, which has a nozzle holder disposed at the back of the cut. The object of the invention of this earlier application is to show the possibility of reducing the dust evolution, which is particularly high at the back of the cut when minerals are mined by means of a cutter drum. The above-mentioned application solves the problem of reducing dust evolution by providing equipment of the kind indicated above, wherein the nozzle holder is mounted on the cutter drum shaft so as to be relatively non-rotatable and of symmetrical construction with respect to rotation. Moreover, the nozzle holder is dimensioned at least so as to correspond to the diameter of the drum body, and it is equipped with nozzles which are distributed over its periphery and form two groups, only one of which is adapted to be fed when the direction of travel of the mining machine is in one direction, while the other group is adapted to be fed only while the direction of travel of the mining machine is in the other direction. The nozzles direct a spray onto the mineral needing to be loosened, said spray pattern extending over the height of the drum. By means of the high-pressure liquid jets leaving them, the nozzles comminute, without any dust evolution, that part of the seam which projects in front of them. The part of the seam located in back of the cut is particularly hard. The nozzles insure that the drum is cut free, as is required, in this zone. With such apparatus, however, the efficiency of the high-pressure water jets leaving the nozzles is impaired, because the water flowing away from the impact area of the jet destroys some of the energy of the impinging high-pressure jet and thus reduces its efficiency.

Cutter drums for mining machines are known which have a conical end ring at the back of the cut, and the end ring bears pick holders which are distributed over its periphery and contain picks which project beyond the drum's end face and cut it free (German Offenlegungsschrift No. 27 22 450).

An object of the present invention is to obviate this defect and to provide direct contact between the mineral needing to be loosened and the high-pressure liquid jet which impinges on this mineral, such contact being unobstructed by the discharged water.

SUMMARY OF THE INVENTION

In cutter-drum apparatus wherein a cutter drum is provided near the back of the cut with a nozzle holder and nozzles for comminuting without dust evolution the harder material at the back of the cut, the invention comprises improvements whereby (a) the nozzle holder is frusto-conical to accommodate the bulging of the face at the back of the cut and (b) the cutter drum has a frusto-conical end ring which bears cutter picks that intersect the jets emerging from the nozzles. These cutter picks give the jets a pulsating action, which increases their effectiveness.

BRIEF DESCRIPTION OF THE DRAWING

A complete understanding of the invention may be obtained from the foregoing and following description thereof, taken in conjunction with the accompanying drawing which is a plan view of a drum support arm and the cutter drum of the invention carried thereby for a longwall mining machine.

DESCRIPTION OF THE PREFERRED EMBODIMENT

The invention starts with a cutter drum of the kind mentioned above, and proposes that the drum be equipped with cutter picks at its end face adjacent the working face. The picks project beyond the drum end face in the direction of the working face, and they extend into the planes of action of high-pressure water jets leaving the nozzle holder. As the drum rotates, the picks projecting beyond the drum end face also move in the vertical plane in which the high-pressure water jets are sprayed by the nozzles on the nozzle holder. In these conditions, the picks intersect the liquid jets in a sequence which is determined by the drum speed and the number of picks, and the picks cause each of the water jets to act pulsatingly on the mineral, for loosening it. The efficacy of the high-pressure water jets is greatly increased in this way, because the operative intervals are always followed by non-operative periods of substantially the same length, during which intervals the water at the impact point of the high-pressure water jet can flow away and leave a free path to the mineral for the high-pressure jet immediately thereafter.

In order to prevent any contact between the nozzle holder and the face bulging out under rock pressure—in the case of the use of equipment of this kind, in which the drum or the nozzle holder is cut free at the end face with the use of such pulsating jets—according to a further feature of the invention, the nozzle holder may be of frusto-conical construction, with its larger-base surface projecting from the end face of the drum body and to beyond the plane of rotation of the end face of the spirals.

One embodiment of the invention is illustrated in the drawing and is explained in detail in the following description.

The support arm of the drum cutter-loader (not shown) is denoted by reference 1, and the body of the cutter drum mounted rotatably thereon is denoted by reference 2. The cutter drum has a conical end ring 3, and it is equipped with cutter picks 4 which are fitted in pick holders 6 secured onto the outer edge of the spirals 5 and at the periphery of the conical end ring 3. A frusto-conical nozzle holder 7, which is here non-rotatably disposed on the shaft 8 of the drum 2 and which is adapted to the shape of the end ring, is situated inside the end ring. Its outside diameter is equivalent to the outside diameter of the end ring 3. The peripheral area is provided with high-pressure nozzles 9 which either extend radially to the drum axis 8 or are inclined to the working face. These high-pressure nozzles 9 are distributed uniformly over the periphery of the nozzle holder 7. The high-pressure nozzles 9 form two groups, of which only one group, the front group (as considered in the direction of machine travel) is fed with high-pressure liquid via conduits 10 of the nozzle holder 7.

Since the nozzles 9 are situated within the range of rotation of the picks 4 of the ring 3, the high-pressure water jets 11 emerging from them are intersected by the picks 4. These jets 11, therefore, have a pulsating action upon the mineral in the back of the cut in the area in front of the drum 2. The jets 11 loosen it extensively, and they not only assist the work of the picks operating in this area of the drum but also effectively bind the resulting dust.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a cutter drum having a cutter drum body rotatably mounted on a shaft and a nozzle holder non-rotatably mounted on said shaft in a location corresponding to the end face of said drum body, said nozzle holder being equipped with nozzles distributed over its periphery, said nozzles being adapted to form, in the mineral to be loosened with the use of said drum, a spray pattern extending over the peripheral portion of said drum body facing the material being mined, a plurality of cutter picks carried on said drum body at said end face thereof, said picks projecting beyond said end face of said drum body and being dimensioned and positioned such that when said drum body is rotated about said shaft and said nozzles are fed to form jets of water, the picks will intersect with said jets to produce a pulsating effect.

2. An improvement as defined in claim 1 further characterized in that said nozzle holder is in the form of a frustrum of a cone, the larger-base surface of said cone projecting away from an end face of the body of said drum.

3. An improvement as defined in claim 1 wherein said nozzle holder is of symmetrical construction with respect to rotation and is dimensioned to correspond with the diameter of the body of said drum.

4. An improvement as defined in claim 3 further characterized in that said nozzle holder is in the form of a frustrum of a cone, the larger-base surface of said cone projecting away from an end face of the body of said drum.

5. An improvement as defined in claim 1 wherein said nozzles form two groups, only a one of which groups is adapted to be fed while using a first direction of machine travel of a mining machine containing such drum and only the other of which groups is adapted to be fed while using a second and opposite direction of machine travel of said mining machine.

6. An improvement as defined in claim 5 further characterized in that said nozzle holder is in the form of a frustrum of a cone, the larger-base surface of said cone projecting away from an end face of the body of said drum.

7. An improvement as defined in claim 5 wherein said nozzle holder is of symmetrical construction with respect to rotation and is dimensioned to correspond with the diameter of the body of said drum.

8. An improvement as defined in claim 7 further characterized in that said nozzle holder is in the form of a frustrum of a cone, the larger-base surface of said cone projecting away from an end face of the body of said drum.

* * * * *